US010924828B2

(12) United States Patent
Wu et al.

(10) Patent No.: US 10,924,828 B2
(45) **Date of Patent: *Feb. 16, 2021**

(54) SPEAKER BOX

(71) Applicant: AAC Technologies Pte. Ltd., Singapore (SG)

(72) Inventors: Jun Wu, Shenzhen (CN); Kaihua Shen, Shenzhen (CN); Wang Sun, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

This patent is subject to a terminal disclaimer.

(21) Appl. No.: 16/525,548

(22) Filed: Jul. 29, 2019

(65) Prior Publication Data

US 2020/0045395 A1 Feb. 6, 2020

(30) Foreign Application Priority Data

Aug. 2, 2018 (CN) ..... 201821242874.8

(51) Int. Cl.
*H04R 1/02* (2006.01)

(52) U.S. Cl.
CPC ..... *H04R 1/023* (2013.01); *H04R 2499/11* (2013.01)

(58) Field of Classification Search
CPC ..... H04R 1/02; H04R 1/025; H04R 1/026
USPC ..... 381/386, 388, 389
See application file for complete search history.

(56) References Cited

U.S. PATENT DOCUMENTS 9,986,321 B1 * 5/2018 She ..... H04R 1/2803
2009/0190788 A1 * 7/2009 Yang ..... H04R 1/2842 381/386

* cited by examiner

*Primary Examiner* — Suhan Ni
(74) *Attorney, Agent, or Firm* — W&G Law Group LLP

(57) ABSTRACT

The present disclosure provides a speaker box which comprises a shell, a support wall, a sound guiding channel, a surrounding wall and a cover plate. The speaker is fixed to support the support wall. The diaphragm of the speaker partitions the receiving space into a front sound cavity and a rear cavity, the sound guiding channel communicates the front sound cavity with the outside and forms a front cavity together with the front sound cavity, the shell, the surrounding wall, the support wall and the cover plate are jointly enclosed as an auxiliary acoustic cavity. The support wall is provided with at least two through-holes intervals, and the auxiliary acoustic cavity is communicated with the front cavity through the through-hole to form a resonant cavity structure of the front cavity. Compared with the related art, the high frequency acoustic performance of the speaker box of the present disclosure is excellent.

6 Claims, 3 Drawing Sheets

SPEAKER BOX

FIELD OF THE DISCLOSURE

The present disclosure relates to electro-acoustic transducers, and more particularly to a speaker box used in a portable electronic device.

DESCRIPTION OF RELATED ART

With the arrival of the mobile internet era, the number of smart mobile devices is being increasing. However, in all these mobile devices, mobile phones are the most common and portable mobile terminal deices. At present, mobile phones are powerful functionality, and one of the powerful functions is the high-quality music function. Therefore, speaker boxes for playing music are widely applied to conventional smart mobile devices.

A speaker box of the related art comprises a shell having a receiving space, a speaker accommodated in the shell and a sound guiding channel defined in the receiving space. The speaker comprises a diaphragm for producing sound via vibrating, the diaphragm partitions the receiving space into a front sound cavity and a rear cavity. The sound guiding channel communicates the front sound cavity with the outside, and cooperatively defines a front cavity with the front sound cavity.

However, in the speaker box of the related art, the space of the front cavity is limited to a region rightly opposite to a dome and a region of the sound guiding channel, and the structure is monotonous and may not be optimized. Therefore, high-frequency acoustic performance of the speaker box is subject to restrictions, and over-high high-frequency responses may cause harsh sounds, sharp dentilabial sounds and the like poor sound effects.

Therefore, it is desired to provide a speaker box to overcome the aforesaid problems.

BRIEF DESCRIPTION OF THE DRAWINGS

Many aspects of the exemplary embodiments can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The present disclosure will hereinafter be described in detail with reference to several exemplary embodiments. To make the technical problems to be solved, technical solutions and beneficial effects of the present disclosure more apparent, the present disclosure is described in further detail together with the figure and the embodiments. It should be understood the specific embodiments described hereby is only to explain the disclosure, not intended to limit the disclosure.

Figure 1:
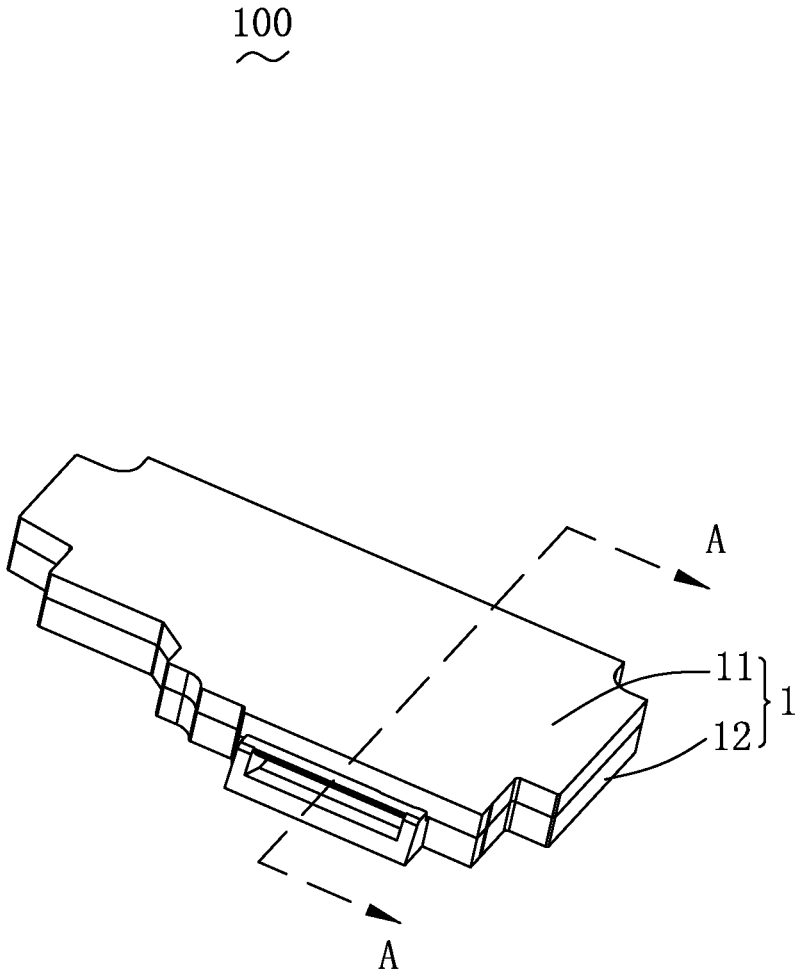
FIG. 1 is a three-dimensional diagram of structure of the speaker box in accordance with an exemplary embodiment of the present disclosure.
Figure 2:
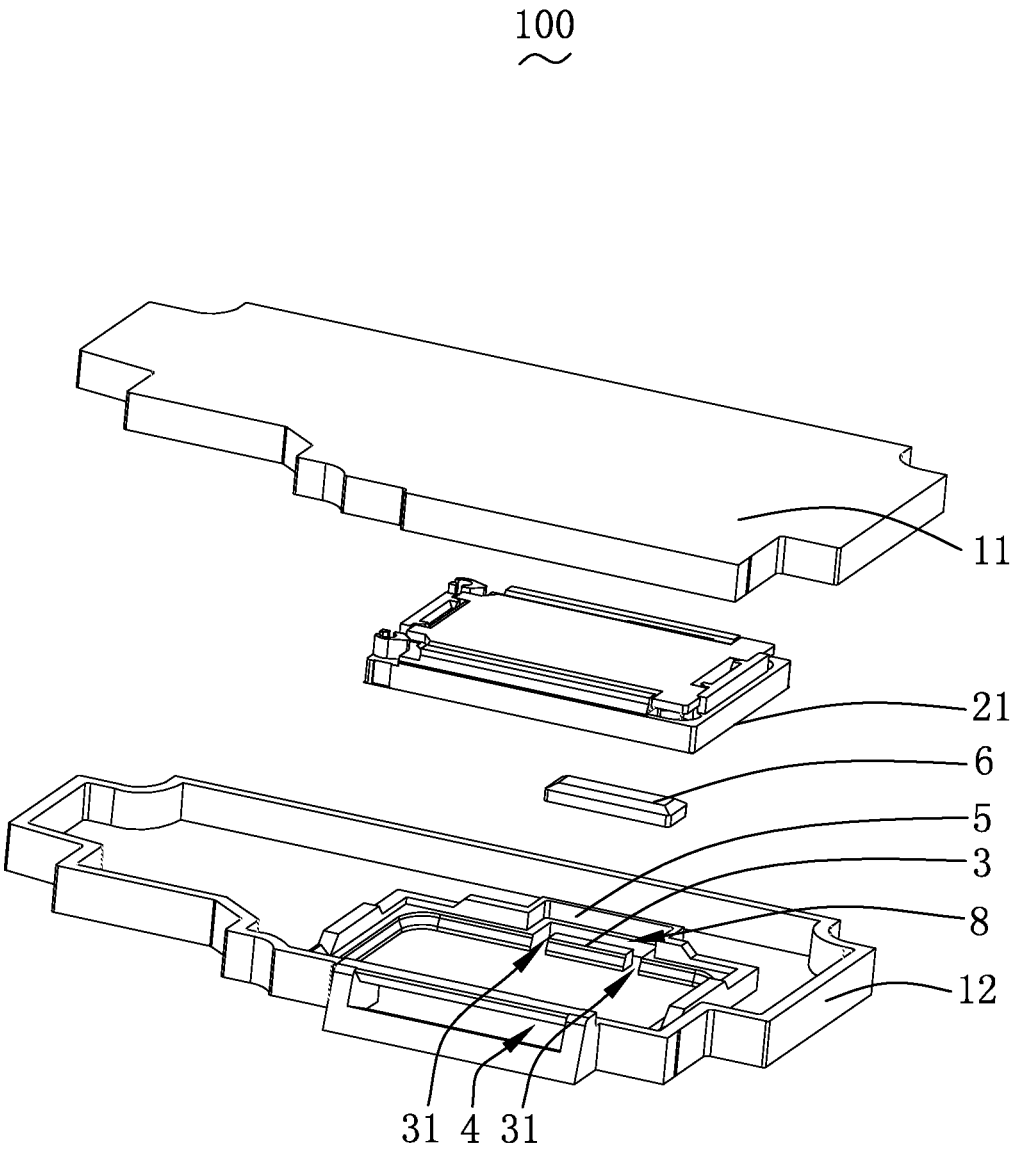
FIG. 2 is a partial three-dimensional perspective diagram of the structure of the speaker box exploded view.
Figure 3:
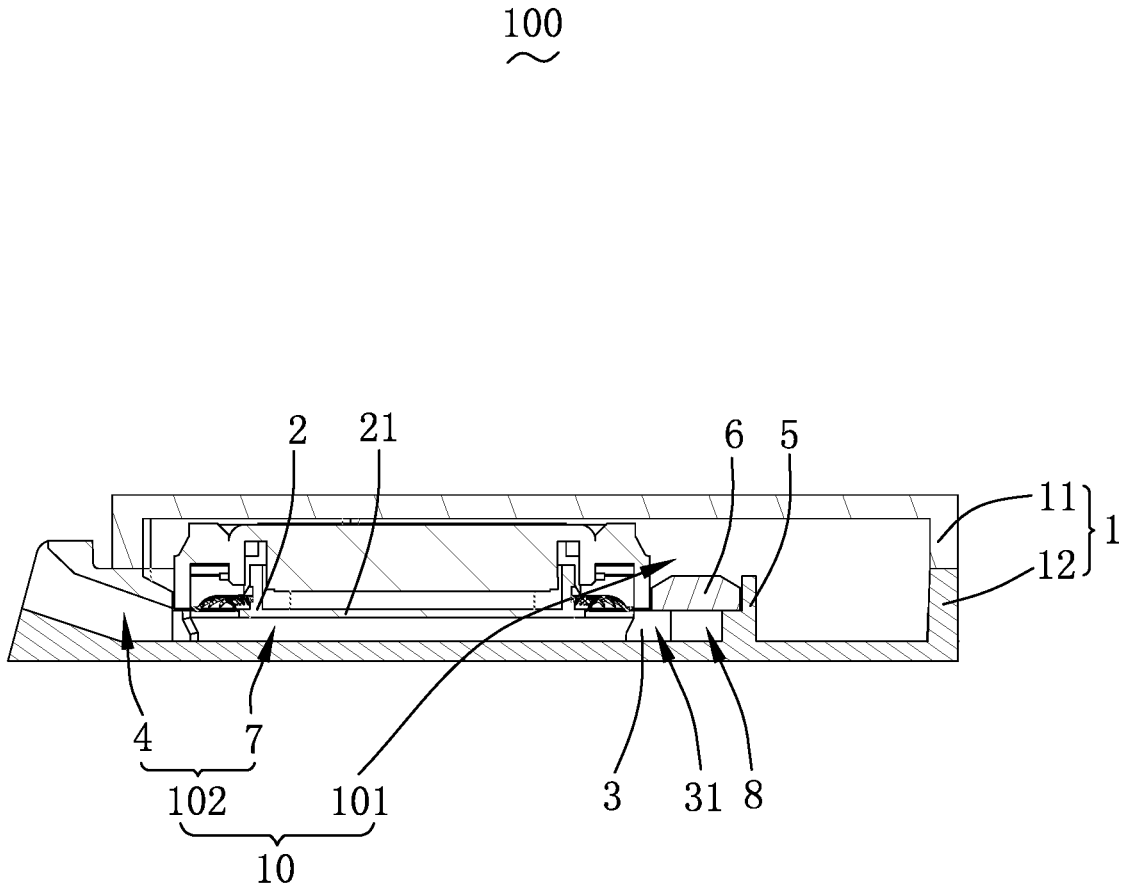
FIG. 3 is a cross-sectional diagram along the A-A line showing in FIG. 1.

Please also refer to FIG. 1 to FIG. 3, wherein FIG. 1 is a three-dimensional structure diagram of the speaker box of the present disclosure, FIG. 2 is a partial three-dimensional perspective diagram of the speaker box exploded view, and FIG. 3 is a cross-sectional diagram along the A-A line showing in FIG. 1. The present disclosure provides a speaker box 100. The speaker box 100 comprises a shell 1 having receiving space 10, a speaker 2, a support wall 3, a sound guiding channel 4, a surrounding wall 5, and a cover plate 6.

The shell 1 may be formed integrally or be formed separately. For example, in this embodiment, the housing 1 includes a lower cover 11, and an upper cover 12 covering with the lower cover 11 and cooperatively defining the receiving space with the lower cover 11.

The speaker 2 is accommodated in the receiving space 10 of the Shell 1, and the speaker 2 partitions the receiving space 10 into a front sound cavity 7 and a rear cavity 101.

In this embodiment, the speaker 2 comprises a diaphragm 21 for producing sound via vibrating, wherein the diaphragm 21 partitions the receiving space 10 into the front sound cavity 7 and the rear cavity 101. Specifically, the diaphragm 21 and the upper cover 12 are spaced apart from each other, and cooperatively define the front cavity 101. The rear cavity 101 is designed to improve low-frequency acoustic performance of the speaker box 100.

The support wall 3 is for supporting and fixing the speaker 2. Specifically, the speaker 2 is fixed to the support wall 3 by glue bonding, which is, of course, without being limited thereto. The support wall 3 is formed by the shell 1 extending into the receiving space 10, that is, the support wall 3 is formed on the upper cover 12. Specifically, the support wall 3 is formed by the upper cover 12 extending downwardly from the lower cover 11. The speaker 2 is supported by the support wall 3 and is enclosed with the upper cover 12 to form the front sound cavity 7. That is, the support wall 3, the diaphragm 21 and the upper cover 12 are spaced apart to define the front sound cavity 7 together. In this embodiment, the support wall 3 comprises at least two through-holes 31 spaced apart from each other. Specifically, the number of the through-holes 31 is two or three and the through-holes 31 are spaced apart from each other in parallel.

The sound guiding channel 4 is formed in the receiving space 10 of the shell 1. In this embodiment, the sound guiding channel 4 is disposed in the upper cover 12. The sound guiding channel 4 communicates the front sound cavity 7 with the outside and is enclosed in a front cavity 102 with the front sound cavity 7. The sound guiding channel 4 is used to form a side sound radiating structure of the front cavity 102.

The surrounding wall 5 is formed by extending from the inner side of the shell 1. Specifically, the surrounding wall 5 is located on the upper cover 1 and outside the support wall 3.

The cover plate 6 is completely covered and fixed to the surrounding wall 5, and the cover plate 6 is made of PET material. PET (Polyethylene terephthalate), commonly known as polyester resin, is easy to process into the cover plate 6 with PET material and is cost-effective.

The speaker box further provides an auxiliary acoustic cavity 8. The auxiliary acoustic cavity 8 is formed in the receiving space 10, for example, formed in the upper cover 12. Specifically, the shell 1, the surrounding wall 5, the support wall 3 and the cover plate 6 collectively enclose the auxiliary acoustic chamber 8. The auxiliary acoustic cavity 8 communicates with the front cavity 102 through a through-hole 31 to form a resonator cavity structure of the front cavity 102. In the present embodiment, the support wall 3 partitions the front cavity 102 from the auxiliary acoustic cavity 8 into two cavities, and cases the auxiliary acoustic cavity 8 to communicate with the front cavity 102 through the through-hole 31, that is, the auxiliary acoustic cavity 8 acts as a part of the front cavity 102 and is used as a resonant cavity structure of the front cavity 102.

On one hand, the structure effectively increases the cavity volume of the front cavity 102 and improves the high frequency acoustic performance, and on the other hand, the auxiliary acoustic cavity 8 structure design is more flexible and varied, the restriction is small and the applicability is higher.

In particular, the auxiliary acoustic cavity 8 is communicated with the front sound cavity 7 through the through-hole 31. Of course, the auxiliary acoustic cavity 8 can also be communicated with the sound guiding channel 4 through the through-hole 31, which is also feasible, and the principle is the same.

In the present embodiment, the speaker box of the present invention can obtain the effect of different frequency response curves by adjusting the amount of the cover plate 6 and through-hole 31, and the high frequency listening feeling is obviously improved.

In actual production, the number of cover plate 6 and through hole 31 can be adjusted, and according to customer preferences to choose the degree of frequency response reduction, so that the speaker box 100 to achieve better sound quality and excellent acoustic performance.

Compared with the relevant technology, the shell, surrounding wall, support wall and cover plate of the speaker box of the present disclosure are jointly enclosed as auxiliary acoustic cavity, and the auxiliary acoustic cavity is communicated with the front cavity to form the resonator structure of the front cavity, so that the auxiliary acoustic cavity severs as a part of the front cavity and acts as a resonant cavity, on the one hand, it effectively increases the cavity volume of the front cavity, improves the high frequency acoustic performance, On the other hand, the auxiliary acoustic cavity structure design is more flexible and diverse, and the applicability is higher, and the above structure can effectively reduce the Q value (quality factor value) and sensitivity of the high frequency resonance peak of the speaker box, which makes the acoustic performance of the speaker box more excellent.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A speaker box, comprising:

a shell having a receiving space;

a support wall, which is formed by the shell extending into the receiving space, wherein the support wall comprises at least two through-holes arranged at each other's intervals;

a speaker, which is accommodated in the receiving space of the shell and is fixedly supported by the support wall, wherein the speaker comprises a diaphragm for producing sound via vibrating, which partitions the receiving space into a front sound cavity and a rear cavity;

a sound guiding channel, which is formed in the receiving space and communicates the front sound cavity with the outside and cooperatively defines a front cavity with the front sound cavity;

a surrounding wall, which is formed by extending from the inner side of the shell and located outside the support wall;

a cover plate, which covers the surrounding wall and is fixed thereat, and the shell, the surrounding wall, the support wall and the cover plate collectively define an auxiliary acoustic cavity, the support wall comprises at least two through-holes spaced apart from each other, and the auxiliary acoustic cavity is communicated with the front sound cavity through the through-hole to define a resonator cavity structure of the front cavity.

2. The speaker box as described in claim 1, wherein the auxiliary acoustic cavity is communicated with the front sound cavity through the through-hole.

3. The speaker box as described in claim 1, wherein the amount of the through-hole is two or three, and the through-hole is set at intervals with each other in parallel.

4. The speaker box as described in claim 1, wherein the material of the cover plate is PET.

5. The speaker box as described in claim 1, wherein the shell comprises an upper cover and a lower cover which is cooperates together with the upper cover to form the receiving space, the support wall and the surrounding wall are formed on the upper cover, the speaker is supported by the support wall and is cooperatively enclosed the front sound cavity with the upper cover.

6. The speaker box as described in claim 1, wherein the speaker is fixed to the support wall by glue bonding.

* * * * *